US006076302A

United States Patent [19]

Otto

[11] Patent Number: 6,076,302

[45] Date of Patent: Jun. 20, 2000

[54] RELEASABLE LOCKING ELEMENT FOR WINGS OF A REVOLVING DOOR

[76] Inventor: Gertjan Otto, Clara Visserstraat 105, 1447 HP Purmerend, Netherlands

[21] Appl. No.: 09/214,074

[22] PCT Filed: Jun. 4, 1997

[86] PCT No.: PCT/NL97/00312

§ 371 Date: May 6, 1999

§ 102(e) Date: May 6, 1999

[87] PCT Pub. No.: WO97/48870

PCT Pub. Date: Dec. 24, 1997

[30] Foreign Application Priority Data

Jun. 20, 1996 [NL] Netherlands ..... 1003383

[51] Int. Cl.[7] ..... E05D 15/02

[52] U.S. Cl. ..... 49/44

[58] Field of Search ..... 49/42, 44, 45

[56] References Cited

U.S. PATENT DOCUMENTS

| | | | |
|---|---|---|---|
| 1,963,881 | 6/1934 | Blanchard . | |
| 2,111,182 | 3/1938 | Hagenbook | 49/44 |
| 2,114,405 | 4/1938 | Shields | 49/44 |
| 2,240,942 | 5/1941 | Peremi et al. | 49/44 |
| 3,793,773 | 2/1974 | Sheckells | 49/44 |
| 4,562,665 | 1/1986 | Blackston | 49/44 |
| 4,640,046 | 2/1987 | Rushford | 49/44 |
| 4,688,350 | 8/1987 | Hattem et al. | 49/44 |
| 4,970,825 | 11/1990 | Knarvik | 49/44 |

FOREIGN PATENT DOCUMENTS

| | | | |
|---|---|---|---|
| 0 340 771 | 5/1989 | European Pat. Off. . | |
| 640887 | 8/1950 | United Kingdom | 49/44 |
| WO 92/08865 | 5/1992 | WIPO . | |

*Primary Examiner*—Jerry Redman

[57] ABSTRACT

A mechanism for locking and releasing individual swivelable door wings of a revolving door is described wherein a blocking element is used to effectively positively lock a cam, connected to the door wing, into a radial position and thus correspondingly lock the door wing in position. The blocking element can be in the form of a ring placed around a shaft about which various door wings can be swiveled and thus simultaneously act on various cams associated with respective door wings. The position of the blocking element is controlled with an electromagnetic arrangement that is so coupled to the blocking element that the failure of electrical power enables the door wing to be swiveled aside.

9 Claims, 2 Drawing Sheets

RELEASABLE LOCKING ELEMENT FOR WINGS OF A REVOLVING DOOR

FIELD OF THE INVENTION

The invention relates to a revolving door provided with a central rotation shaft and with door wings attached to the rotation shaft which door wings can be swivelled aside, and having locking means for locking the door wings in their radial position in relation to the rotation shaft, wherein each door wing is provided with a movable cam which moves when the door wing is swivelled aside and that a locking element is provided, having a movable position and a fixed position, and that the locking element abuts to the cam such that movement of the cam displaces the locking element and that the fixed position of the locking element corresponds at least to the radial position of the door wing.

BACKGROUND OF THE INVENTION

Such a revolving door is known in many kinds of embodiments. The lock used with such revolving doors serves to allow the door wings, after the lock is placed in the unlocked position, to be swivelled aside to provide a spacious escape route. However, during normal use the door wings must be securable in their radial position so that the door can be used as revolving door in its many applications.

U.S. Pat. No. 4,562,665 teaches a magnetic door breakaway system for remote unlocking of doors and apertures. An electromagnet and armature are mounted within a doorframe. Within either the magnet or the armature are depressions and corresponding projections in the other. The document teaches that the armature is preferably movably affixed to the top of the doorframe and by energizing the electromagnet, the projections mate with the depressions make movement of the doorwing impossible. In an emergency situation, the magnet is de-energized and the doorwing may open freely.

From U.S. Pat. No. 4,970,825 a revolving door is known having a plurality of door leaves extending radially outwardly from a center shaft in angularly spaced positions. The door includes upper and lower collapsing mechanisms which are adapted to normally maintain the door leaves in their radial positions, but permit pivotal movement of each door leaf to a collapsed position in the event that the door leaf is subjected to abnormal forces. This document teaches to apply a locking assembly with an electromagnet, which normally is operated to prevent the collapsing mechanism from functioning, so that the door leaves can be collapsed. In the event of an emergency situation, the locking assembly is quickly rendered inoperable by de-energizing the electromagnet, which permits then pivotal movement of the door leaves to their collapsed positions.

SUMMARY OF THE INVENTION

According to the invention, the revolving door is characterized in that the locking element takes the form of a ring abutting against each of the movable cams when all the door wings are in the same position and which ring, in its movable position, can be displaced by each of the cams, and that when the door wings are swivelled aside, the locking element engages the fixed position.

This provides a simple facility by which the door wings can be locked in both their radial and swivelled aside positions in relation to the rotation shaft, and by which the lock can be simply released, in order to be able to adapt to panic situations or other reasons for needing to provide an enlarged passageway or to return to the normal operational radial position of the door wings. Preventing that the swivelled aside doors may assume the radial position again is useful in the case of panic situations.

It is in particular desirable that the locking element between the movable and the fixed position can be remote controlled. In this way it is not necessary to each time move the lock into the desired position at the revolving door itself, but this can then be done, for instance in night situations, from a central security unit. In addition, the arrangement for the remote control of the locking element between the movable position and the fixed position meets the ever increasing safety requirements. This means that the door remains operable, even if in its vicinity a fire or other panic situation develops.

Preferably, electromagnetic means are provided for switching the locking element from the movable position to the fixed position and vice versa. This type of control has proven itself to be especially reliable and permits a great variety of embodiments.

The electromagnetic means may, for instance, comprise a stationary coil and movable armature, wherein the locking element is connected with the armature. There is a choice of various fail-safe-situations. For instance, the locking element may be connected with the armature such that when the coil is currentless, the locking element assumes the fixed position, for instance under the influence of gravity, when the locking element assumes a position which blocks the cam's path when the door wing connected thereto, moves.

According to the invention it is preferred, however, that both the locking element and the cam are each provided with a bevelled, abutting surface, with the locking element being located substantially above the cam, and that, when the coil is excited, the locking element is in the fixed position.

In a desirable embodiment the ring is bearing-mounted on the central rotation shaft. It is advantageous if the armature is connected with the bearing.

BRIEF DESCRIPTION OF THE DRAWINGS

The invention will now be elucidated with reference to the drawing which shows schematically in FIG. 1 a horizontal cross-section of a central rotation shaft to which are fastened, and shown in part, wings of a revolving door, which wings can be swivelled aside according to the invention; and in FIG. 2 a vertical cross-section of part of a revolving door according to the invention near the central rotation shaft.

DETAILED DESCRIPTION OF THE DRAWINGS

Identical reference numbers used in the Figures refer to identical parts.

Figure 1:
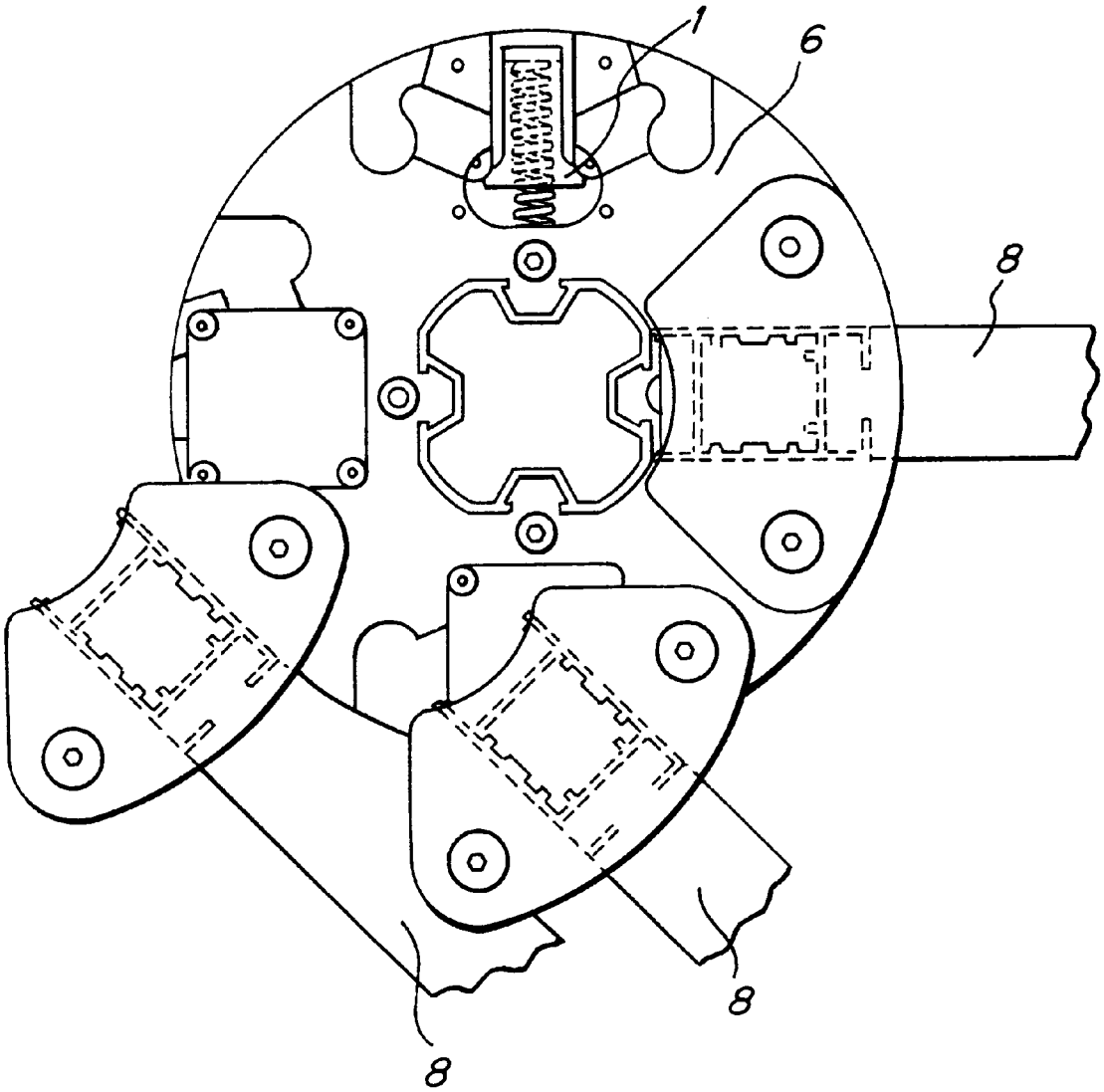

In FIG. 1, representing a horizontal cross-section of a part of a revolving door according to the invention, a central rotation shaft 6 is shown, to which door wings 8 are attached. The Figure shows two door wings 8 in the swivelled-aside position, one door wing 8 in the radial position, and one door wing is not shown but instead of that a cam 1 is shown which under the influence of the respective door wing carries out a radial movement as explained in more detail with reference to FIG. 2.

Figure 2:
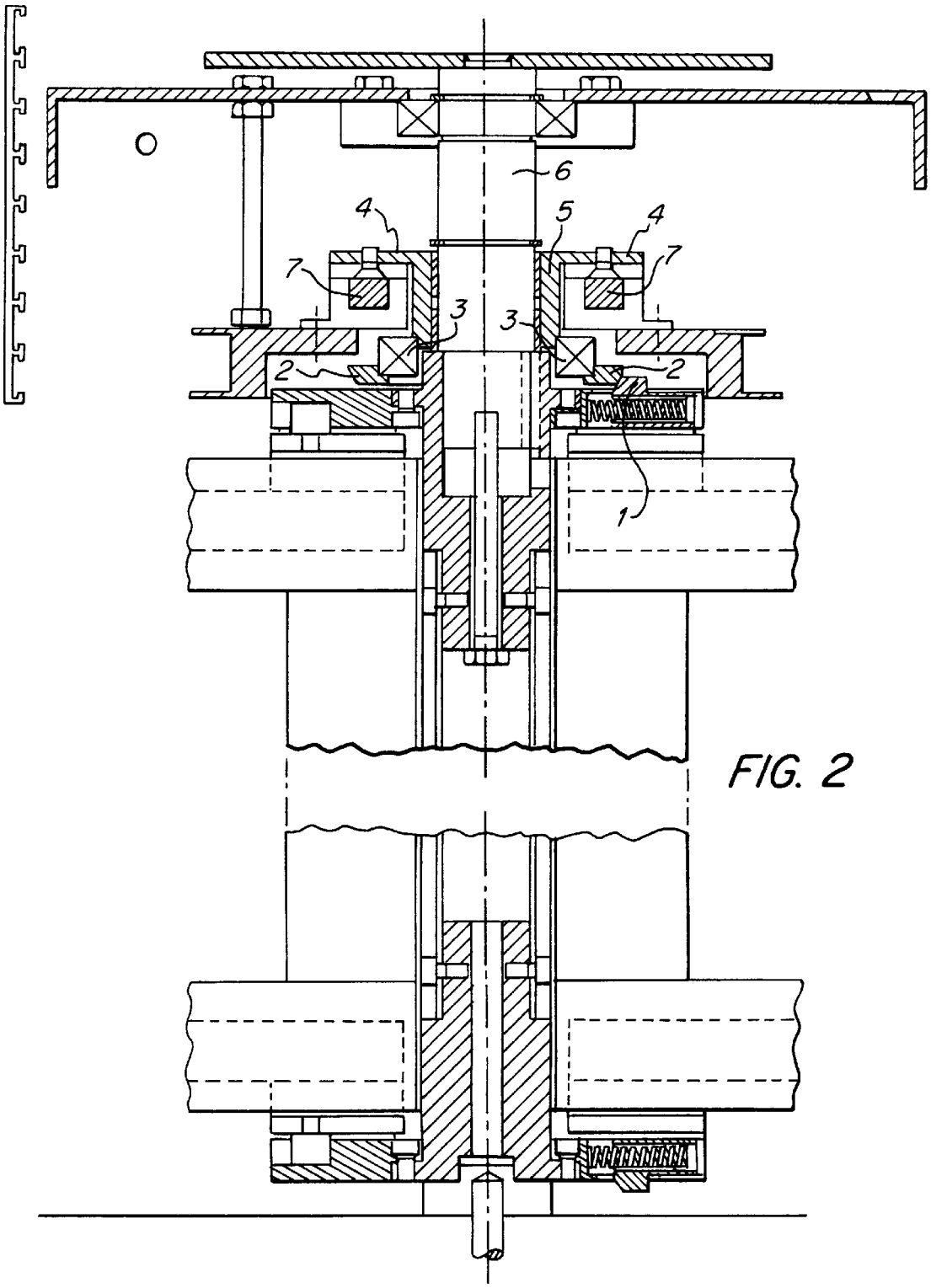

FIG. 2 represents a vertical cross-section of a revolving door according to the invention, showing the central rotation shaft 6 and on both sides of said shaft, schematically, the locking mechanism of this revolving door's wings aligned in each others extension.

The following explanation refers to one of these locking mechanisms, but it is fully applicable to locks of the other door wings.

The figure shows a cam 1 in cross-section which cam, through the effect of the door wing coupled thereto being swivelled, is able to move the door wing radially inward, depending on whether a blocking element 2 (being a ring carrying out the function now to be described with all door wings in the same manner) assumes a fixed or movable position. The ring 2 and the cam 1 have a complementary bevelled surface so that when the ring 2 is in the movable position, the radial inward movement of the cam 1 causes the ring 2 to move upward. This upward movement is a consequence of the ring 2 being bearing-mounted on the central shaft 6 by means of a bearing 3. In the fixed position, the ring 2 cannot move upward, so that the cam 1 cannot carry out its radial inward movement and the door wing coupled thereto is locked in the radial position. The fixed position of the ring 2 is obtained by having an armature 4 connected to the bearing 3, which armature is part of an electromagnetic arrangement that can be excited by means of a coil 7. On excitation, the coil 7 draws the armature 4 toward itself so that the ring 2, being connected with the armature 4 via the bearing 3, is fixed downward. Naturally, this electromagnetic system has to have the appropriate dimensions to withstand the forces exerted on it by the cam 1 via the ring 2. By interrupting the excitation of the coil 7, the movement of the armature 4 and with it the ring 2, is released so that the cam 1 and the door wing coupled thereto, can be moved from the radial position to a swivelled aside position. As soon as the door wings 8 are placed in the swivelled aside position, the coil 7 may be reexcited in order to move the blocking element, the ring 2, downward so that said blocking element blocks the respective cams 1 which are swivelled aside together with the door wings 8. In this manner the door wings 8 are fixed in their swivelled aside position.

It should be noted, that the above description relates to a preferred embodiment of the revolving door according to the invention and that within the scope of the appended claims, sundry variants are feasible.

What is claimed is:

1. A revolving door provided with a central rotation shaft and with door wings attached to the rotation shaft, which door wings can be swiveled aside from a radial position, and having locking means for locking the door wings in their radial position in relation to the rotation shaft, comprising: at least one of the door wings being provided with a movable cam which moves when the door wing is swivelled aside and a blocking element being movable from a position and being able to be fixed into the position, the blocking element abutting the cam such that movement of the cam can displace the blocking element from its position while the fixed position of the blocking element corresponds at least to the radial position of the door wing to effectively positively lock the cam from being moved.

2. A revolving door according to claim 1, characterized in that the fixed position of the blocking element corresponds with the swiveled aside position of the door wing.

3. A revolving door according to claim 1 and including an actuator which can be remote controlled for effectively positively locking or enabling movement of the blocking element from the fixed position.

4. A revolving door according to claim 1, characterized in that each of the door wings is provided with a movable cam which, when swivelling aside the respective door wing, executes a movement and, wherein the blocking element takes the form of a common ring abutting against each of the movable cams when all the door wings are in the same position and which ring can be displaced by each of the cams from its effectively positively locking position.

5. A revolving door according to claim 4, and further comprising a bearing for supporting the ring and with the ring mounted on the central rotation shaft.

6. A revolving door provided with a central rotation shaft and with door wings attached to the rotation shaft, which door wings can be swiveled aside from a radial position, and having locking means for locking the door wings in their radial position in relation to the rotation shaft, comprising: at least one of the door wings being provided with a movable cam which moves when the door wing is swivelled aside and a blocking element being movable from a position and being able to be fixed into the position, an actuator which can be remote controlled for effectively positively locking or enabling movement of the blocking element from the fixed position; the blocking element abutting the cam such that movement of the cam can displace the blocking element from its position while the fixed position of the blocking element corresponds at least to the radial position of the door wing to effectively positively lock the cam from being moved; wherein the actuator comprises electromagnetic means for enabling movement of the blocking element from the fixed position and effectively locking the blocking element into its fixed position.

7. A revolving door according to claim 6, characterized in that the electromagnetic means comprises a stationary coil and movable armature, wherein the blocking element is connected with the armature.

8. A revolving door according to claim 7, characterized in that both the blocking element and the cam have bevelled, abutting surfaces, with the blocking element being movable along the shaft of rotation and so connected to the armature that, when the coil is excited, the blocking element is in the position in which the cam is effectively positively locked.

9. A revolving door provided with a central rotation shaft and with door wings attached to the rotation shaft, which door wings can be swiveled aside from a radial position, and having locking means for locking the door wings in their radial position in relation to the rotation shaft, comprising: at least one of the door wings being provided with a movable cam which moves when the door wing is swivelled aside and a blocking element being movable from a position and being able to be fixed into the position, an actuator which can be remote controlled for effectively positively locking or enabling movement of the blocking element from the fixed position; the blocking element abutting the cam such that movement of the cam can displace the blocking element from its position while the fixed position of the blocking element corresponds at least to the radial position of the door wing to effectively positively lock the cam from being moved; wherein the actuator comprises electromagnetic means for enabling movement of the blocking element from the fixed position and effectively locking the blocking element into its fixed position; the electromagnetic means having a stationary coil and a movable armature connected with the blocking element, a bearing for supporting the blocking element which is mounted on the central rotation shaft and with the armature connected with the bearing.

* * * * *

UNITED STATES PATENT AND TRADEMARK OFFICE

CERTIFICATE OF CORRECTION

PATENT NO. : 6,076,302
DATED : June 20, 2000
INVENTOR(S) : Gertjan Otto

It is certified that error appears in the above-identified patent and that said Letters Patent is hereby corrected as shown below:

After the Inventor information, please insert:

Assignee: Boon Edam, B.V.; Edam, The Netherlands

Signed and Sealed this

Twelfth Day of June, 2001

Nicholas P. Godici

*Attest:*

*Attesting Officer*

NICHOLAS P. GODICI
*Acting Director of the United States Patent and Trademark Office*